United States Patent [19]

O'Toole

[11] Patent Number: 4,894,758

[45] Date of Patent: Jan. 16, 1990

[54] LIGHTING COVER AND COMBINATION FOR CORNER INSTALLATION

[75] Inventor: John M. O'Toole, Culver City, Calif.

[73] Assignees: Theresa A. Hasty; Donald B. Hasty, both of Los Angeles, Calif.

[21] Appl. No.: 402,764

[22] Filed: Sep. 5, 1989

[51] Int. Cl.[4] ..... F21S 1/02

[52] U.S. Cl. ..... 362/147; 362/368

[58] Field of Search ..... 362/147, 368

[56] References Cited

U.S. PATENT DOCUMENTS

| | | | |
|---|---|---|---|
| 4,352,151 | 9/1982 | Lewis | 362/368 |
| 4,569,003 | 2/1986 | Elmer | 362/147 |

FOREIGN PATENT DOCUMENTS

| | | | |
|---|---|---|---|
| 667739 | 6/1929 | France | 362/147 |
| 1147969 | 4/1969 | United Kingdom | 362/147 |

*Primary Examiner*—Douglas Hart

*Attorney, Agent, or Firm*—Henry M. Bissell

[57] ABSTRACT

A light which may be mounted in a corner is disclosed which utilizes a light cover having a unique configuration specifically designed to be quickly and conveniently mounted in a corner or like location, with any of several lighting arrangements being located in the corner under the light cover. The light cover is made of translucent material which will disseminate the light from a light source contained under the light cover, which consists of an essentially rectangular segment which is bent along one diagonal to form a configuration which will fit entirely in a corner. Either a fluorescent tube or one or more incandescent light bulbs may be used as the light source, which in the preferred embodiment is mounted in a socket apparatus which is installed in the corner on one or both of the surfaces forming the corner, thereby centrally locating the light source with respect to the light cover which is anchored to the wall or ceiling.

22 Claims, 2 Drawing Sheets

LIGHTING COVER AND COMBINATION FOR CORNER INSTALLATION

BACKGROUND OF THE INVENTION

1. Field of the Invention

The present invention relates generally to a light which may be mounted in a corner, and more particularly to a unique configuration for a lamp cover specifically designed to be quickly and conveniently mounted in a corner or like location, with any of several lighting arrangements being located in the corner under the lamp cover.

2. Description of the Related Art

In the field of interior decorating, there is a wide variety of lighting available for most applications in a home or business. Such lighting falls into two basic categories, namely stand-alone lighting, and built-in lighting. Stand-alone lighting includes any light or fixture which does not require substantial installation and which may easily be moved, such as floor and table lamps, lamps hung or suspended from hooks in walls or ceilings, and lamps placed on various pieces of furniture. Built-in lamps include all types of ceiling and wall fixtures, track lighting, and other lamps requiring installation.

A wide variety of built-in lighting is available for installation in homes or offices to illuminate them. Built-in fixtures mounted in recessed fashion in the ceiling are commonly used to provide the main illumination for rooms. Such ceiling-mounted fixtures are generally installed at the time of original construction, since they typically require an aperture in the ceiling as well as an installed power line for their installation.

Also popular, particularly in residential installations, is the box-mounted ceiling light fixture. At the time of original construction, an electrical box is installed in the ceiling , generally in a position in or near the middle of the room. The box is installed in a recessed position in the ceiling, with a power line running to the box to supply power for the light. It is quite easy to remove a fixture attached to the box, and to replace it with another fixture.

Another type of fixture which is also used commonly in residential construction is the wall-mounted light fixture. Such fixtures are particularly common in certain rooms of the house. For example, in a room having a fireplace it is common to use two wall-mounted lighting fixtures above the fireplace, one on each side of the fireplace. Such fixtures are also typically installed at the time of original construction, since they require a recessed box and a power line, which for cosmetic reasons is typically below the wall surface.

Thus, it may be seen that it is common to install lighting fixtures on the ceiling or in the walls of a room. It is also easy to locate a stand-alone light or floor lamp in a room, since most rooms have electrical plugs located at intervals around the room. In fact, the only place in a typical room where lighting is not located is in the corners, whether the corners between walls or the corners between the ceiling and a wall. For whatever reason, lighting fixtures have simply not been located in corners.

In fact, it is virtually impossible to purchase a fixture intended for installation in a corner. Rather, it is possible to locate some types of fixtures, such as a swag lamp which hangs on a chain, near a corner, but not in the corner itself. This is so because lamp fixtures are designed for installation onto a flat surface, not into a corner which is the intersection between two flat surfaces. Therefore, it will be appreciated that the best which may be done if it is desirable to locate a fixture in a corner is to locate it near to that corner.

It will also be recognized that this is not acceptable in most cases since lighting fixtures tend to be designed to throw light in a direction opposite the flat surface on which they are mounted. Thus, if a lighting fixture is designed for installation onto a flat surface, when it is mounted near a corner it will throw most of its light along the wall adjacent the wall it is mounted on. This uneven distribution of light, rather than an even distribution emanating from the corner, is typically aesthetically unacceptable.

Accordingly, it is the primary objective of the present invention to provide a fixture which may be installed in a corner, either between two walls or between the ceiling and a wall. It is desirable that the fixture be designed to closely fit the contours of a corner, to provide a built-in look which is pleasing to the eye. The fixture should be easy to install, requiring only a brief effort and simple hand tools to complete the installation process, thus making the corner fixture of the present invention ideal for installation by do-it-yourselfers.

It is a further objective of the present invention that the corner lighting fixture should evenly distribute light from the corner, rather than throwing the light to one wall or the other. The corner lighting fixture must present an aesthetically pleasing appearance, making it an attractive addition to a room or office. It is an additional objective of the present invention that the lighting fixture take up little room, and that it not project from the corner to any significant degree.

It is also an objective of the present invention that the corner lighting fixture be inexpensive of construction, thereby making it an economically attractive product which will prove appealing to people seeking to add additional lighting for a home or office. It must also be durable and long lasting, which feature, when added to its qualities of being easy to install, effective at providing light for a significant area, and relatively inexpensive, will make the corner light fixture of the present invention a highly desirable alternative to traditional wall and ceiling lights. Finally, it is desirable that the corner lighting fixture of the present invention provide all of the aforesaid advantages and objectives without resulting in any significant disadvantage.

SUMMARY OF THE INVENTION

The disadvantages and limitations of the background art discussed above are overcome by the present invention. With this invention, a light designed for installation in a corner is disclosed which uses a unique cover to disseminate the light from a light source contained thereunder. The cover consists of an essentially parallelogram segment of translucent material which is bent along one diagonal to form a configuration which will fit entirely in a corner. In this configuration, the edges of the cover will be exactly contoured to the surface of the walls (or the surfaces of the ceiling and one wall) when the cover is placed against the surfaces forming the corner.

To place the cover against the surfaces of a corner, the cover is brought into contact with the surfaces on which it is to be mounted with the bend in the rectangular segment of translucent material oriented away from the corner. The cover will fit into the corner in a near vertical orientation, with one shorter edge of the rectangular segment placed against one surface adjacent the corner, and the other short edge of the rectangular segment placed against the other surface adjacent the corner. The long edges of the rectangular segment forming the cover will then also lie against the two surfaces.

Prior to installation of the cover, installation of the portion of the corner lighting fixture including the light is accomplished. Various types of lights could be used; for example, either a fluorescent tube or one or more incandescent light bulbs may be used as the light source. In the preferred embodiment, the socket apparatus together with the tube or bulb is mounted in the corner onto one or both of the surfaces forming the corner. The light source is located centrally to the position of the cover, and is anchored to the wall or ceiling.

The cover is then placed over the light source, and is attached to the two surfaces forming the corner, using two screws. In the preferred embodiment, on one short side of the rectangular segment of translucent material forming the cover a short slot is located. On the other short side of the rectangular segment, a longer slot is located. When the cover is placed against the corner over the light source, screws are placed in the two slots, with one screw going to one wall and the other screw going to the other wall. With both screws located in the wall, the longer slot may be moved entirely over the higher screw. From this position, the cover may be dropped slightly to slide the shorter slot over the lower screw. Both screws may then be tightened to fasten the cover firmly to the corner.

The cord used to supply power to the corner light fixture of the present invention may either be plugged into an outlet located on one of the surfaces forming the corner if the outlet is beneath the cover, or it may extend out from under the cover to the floor, where it may then be plugged into a standard wall or floor outlet. A switch could be used in conjunction with an outlet located under the cover to control the light, or a switch may be included in the electrical line of the light. The latter type of switch could be located either in the cover, or in the cord extending from the corner light fixture.

The heart of the present invention, of course, is the geometric configuration of the light cover. As stated above, the light cover is formed from a parallelogram-shaped segment of material, which is bent along one diagonal. The bend may either be formed as a break, or a more gently radiused bend which would require special treatment at the corners to make the bent rectangular segment closely fit the corner. The bend may also comprise a pair of angular breaks with the break lines coming together as they approach the ends of the cover.

Also, the rectangular configuration is important to the concept underlying the present invention. As the rectangular configuration more closely approaches that of a square, the vertical height of the light cover will steadily diminish. At a square, the height would be zero (assuming the corner the light cover is to fit is square). It has been found that the length of the rectangular segment must be at least approximately 1.25 times the width of the rectangular segment for a practical light cover to be manufactured. In the preferred embodiment, the length of the rectangular segment forming the light cover is between 1.5 and 10 times as long as the width.

DESCRIPTION OF THE DRAWINGS

A better understanding of the present invention may be realized from a consideration of the following detailed description, taken in conjunction with the accompanying drawing in which.

DETAILED DESCRIPTION OF THE PREFERRED EMBODIMENT

Figure 1:
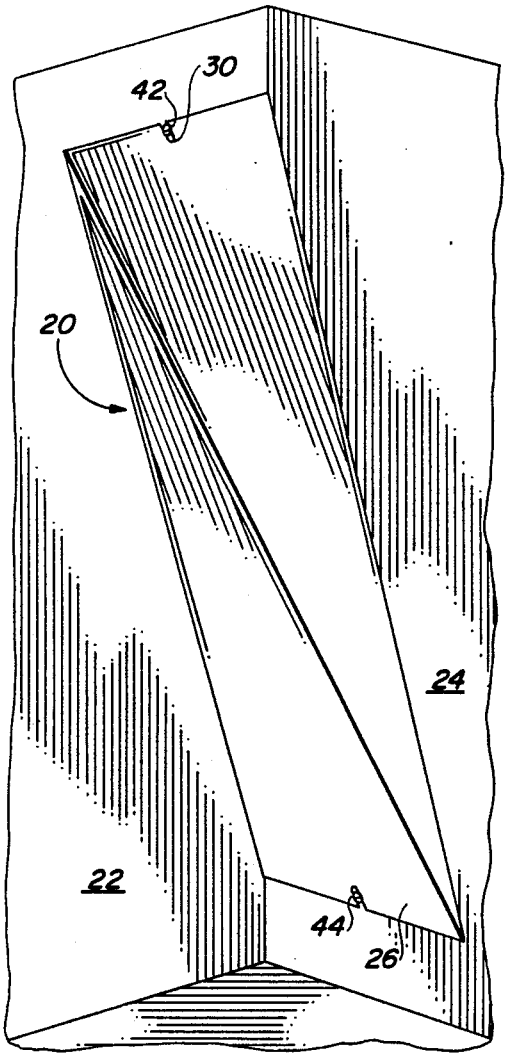
FIG. 1 is a perspective view of a corner light fixture constructed according to the teachings of the present invention.
Figure 2:
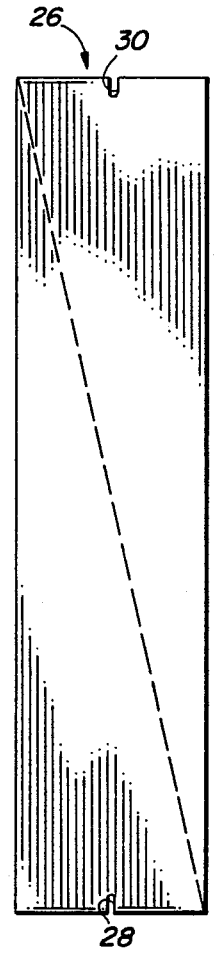
FIG. 2 is a plan view of the rectangular segment of translucent material used to form the light cover of the corner light fixture shown in FIG. 1, showing the diagonal on which the rectangular segment will be bent.
Figure 3:
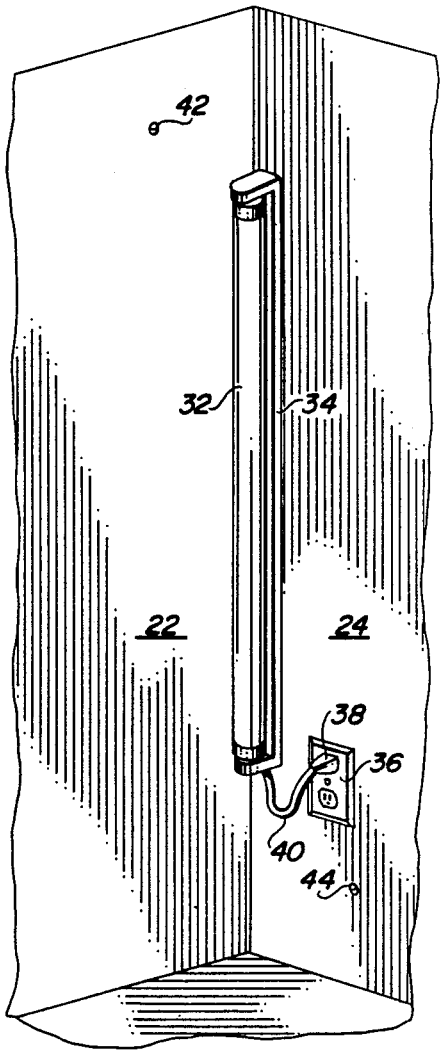
FIG. 3 is a perspective view of the corner light of FIG. 1 with the light cover removed to show the fluorescent tube used as the light source, and the wall plug.

The preferred embodiment of the present invention is illustrated in FIG. 1, which shows a corner light fixture 20 mounted in a corner formed by a first wall 22 and a second wall 24. In the preferred embodiment, the corner light fixture 20 consists of two basic components, which are mounted separately onto the first and second walls 22 and 24. The first of these components is a light cover 26, which is best shown in FIGS. 1 and 2. The other main component of the corner light fixture 20 is the light source, which is mounted under the light cover 26. The light source used with the corner light fixture 20 is shown in FIG. 3.

Referring again to FIGS. 1 and 2, the construction of the light cover 26 of the corner light fixture 20 will first be discussed. The light cover 26 is preferably made of a rectangular segment of material which is at least partially transparent to light. In the preferred embodiment, the material is translucent, allowing light to pass therethrough, but preventing the light source under the light cover 26 from being clearly seen when the corner light fixture 20 is installed. Milky white plastic material has long been used in panels for built-in ceiling light fixtures, and this material thus has excellent optical properties making it ideal for use as the material of the light cover 26.

The shape of the segment used to make the light cover 26 is a parallelogram, preferably rectangular according to the teachings of the present invention, and the rectangular configuration must not too closely approach a square, for reasons which will become evident below. The rectangular segment of translucent material used to make the light cover 26 is illustrated in FIG. 2 prior to the bend being made, and is approximately four times as long as it is wide. The bend in the light cover 26 is made along a diagonal of the rectangular segment, with the particular diagonal chosen being shown in dotted lines in FIG. 2. Either diagonal may of course be used, depending on the way the light cover 26 is installed into the corner; this will become further evident in conjunction with the discussion of FIG. 10 below.

The bend in the light cover 26 is a sharp bend of approximately ninety degrees, to enable the cover to fit snugly against the first and second walls 22 and 24, which typically form an approximately ninety degree bend therebetween. The bottom edge of the light cover 26 has a short slot 28 located therein near the center of the bottom of the light cover 26, which short slot 28 is for receiving a screw to secure the bottom of the light cover 26. The top of the light cover 26 has a longer slot 30 located therein near the center of the top of the light cover 26, which longer slot 30 is for receiving a screw to secure the top of the light cover 26.

When the light cover 26 is placed in position in the corner between the first and second walls 22 and 24, the top edge of the light cover 26 will lie flush against the first wall 22 and the bottom of the light cover 26 will lie flush against the second wall 24, as shown in FIG. 1. The two long edges of the light cover 26 will also lie flush against the first and second walls 22 and 24. Accordingly, it will be perceived by those skilled in the art that the appearance of the light cover 26 when placed in a corner is aesthetically quite pleasing.

The light source used with the corner light fixture 20 is a straight fluorescent tube 32, as shown in FIG. 3. The fluorescent tube 32 is mounted in a socket assembly 34, which is used both to hold the fluorescent tube 32 therein and to provide electricity to the fluorescent tube 32. The socket assembly 34 and the fluorescent tube 32 fitting therein are shorter than the light cover 26, so that they will fit entirely under the light cover 26 when it is installed in the corner between the first and second walls 22 and 24. The socket assembly 34 may be mounted to either or both of the first and second walls 22 and 24 in any of the number of manners well known in the art, typically by using screws (not shown).

Various different ways may be used to supply electricity to the socket assembly 34 and to switch the fluorescent tube 32 in the socket assembly 34 on and off. In the corner light fixture 20 shown in FIGS. 1 through 3, power is supplied through a switched outlet 36 which is mounted in the second wall 24 in a position which will be under the light cover 26 when the light cover 26 is installed. A plug 38 and a cord 40 connected to the plug 38 at one end and to the socket assembly 34 at the other end are used to supply power from the switched outlet 36 to the socket assembly 34. When the switched outlet 36 is turned on, the fluorescent tube 32 will be lighted; when the switched outlet 36 is turned off, the fluorescent tube 32 will not be lighted.

Two screws 42 and 44 are used to retain the light cover 26 in place over the fluorescent tube 32 and the socket assembly 34 in the corner between the first and second walls 22 and 24. The screw 42 is screwed into the first wall 22 to hold the top of the light cover 26 in position in the corner. The screw 44 is screwed into the second wall 24 to hold the bottom of the light cover 26 in position. Note that when the light cover 26 is installed as shown in FIG. 1, the screw 42 will be in the longer slot 30 in the top of the light cover 26, and that the screw 44 will be in the short slot 28 in the bottom of the light cover 26.

In the preferred embodiment, the longer slot 30 is deliberately longer to allow for easy installation and removal. To remove the light cover 26, both of the screws 42 and 44 are loosened, and the light cover 26 is moved upward so that the screw 42 is at the bottom of the longer slot 30 and the screw 44 is free of the short slot 28. The bottom of the light cover 26 may then be pulled out away from the screw 44, and the light cover 26 may be moved downward to disengage the longer slot 30 from the screw 42, freeing the light cover 26 from the first and second walls 22 and 24.

To install the light cover 26, the longer slot 30 in the top of the light cover 26 is first moved fully into engagement with the screw 42. The bottom of the corner light fixture 20 is then placed against the second wall 24, and the light cover 26 is moved downward to engage the screw 44 with the short slot 28. Both of the screws 42 and 44 are then tightened, securing the light cover 26 to the first and second walls 22 and 24. It will be appreciated by those skilled in the art that this installation and removal of the light cover 26 are quite easy to accomplish.

As has been stated above, the light cover 26 is made of a piece of material which is preferably of a rectangular configuration not too closely approaching a square. As the rectangular configuration more closely approaches that of a square, the vertical height of the light cover will steadily diminish. At a square, the height would be zero (assuming that the corner the light cover is to fit into is square with walls ninety degrees apart). It has been found that the length of the rectangular segment must be at least approximately 1.25 times the width of the rectangular segment for a practical light cover to be manufactured. In the preferred embodiment, the length of the rectangular segment forming the light cover is between 1.5 and 10 times as long as the width.

Figure 4:
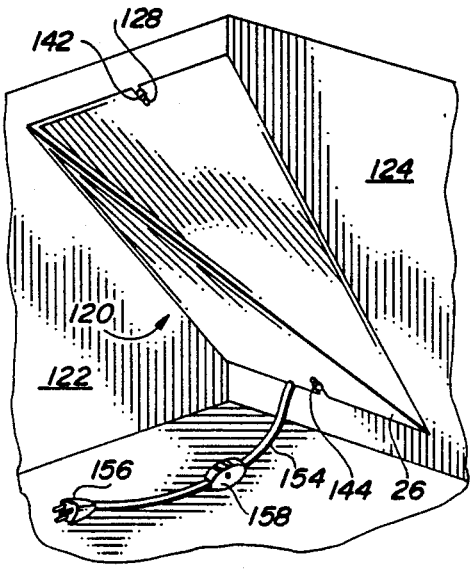
FIG. 4 is a perspective view of a second corner light fixture constructed according to the teachings of the present invention.
Figure 5:
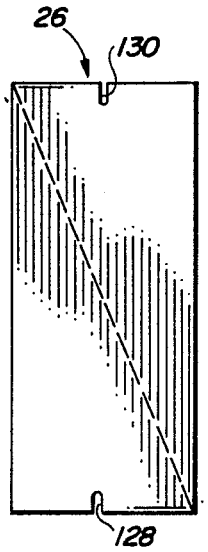
FIG. 5 is a plan view of the rectangular segment of translucent material used to form the light cover of the corner light fixture shown in FIG. 4, showing the diagonal on which the rectangular segment will be bent.
Figure 6:
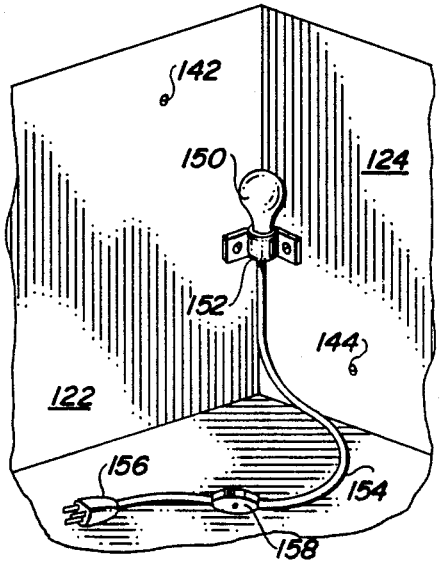
FIG. 6 is a perspective view of the corner light of FIG. 4 with the light cover removed to show the incandescent bulb used as the light source, and the cord including the in-line switch.

Referring now to FIGS. 4 through 6, a corner light fixture 120 is shown which has a light cover 126 made from a rectangular segment having a length which is twice its width. The corner light fixture 120 is installed onto first and second walls 122 and 124. The light cover 126 is bent along a diagonal, and has a short slot 128 in the bottom edge thereof and a longer slot 130 in the top edge thereof. The light cover 126 is fastened to the first and second walls 122 and 124 with two screws 142 and 144.

Note in FIG. 4 how much greater the relative width across the first and second walls 122 and 124 of the corner light fixture 120 is compared to that of the corner light fixture 20 of FIG. 1. It will thus be perceived that the limits above on the rectangularity of the segment of material used to make a cover are necessary to avoid making a cover which would be so much wider than it is tall that it would be unusable.

Referring particularly to FIG. 6, is may be seen that the light source for the corner light fixture 120 is an incandescent light bulb 150. The light bulb 150 is mounted in a socket 152, which is mounted to the first and second walls 122 and 124. A cord 154 is connected at one end to the socket 152, and at the other end to a plug 156. An in- line switch 158 is installed in the cord 154. The plug 156 may be plugged into an outlet (not shown) or an extension cord (not shown), and the in-line switch way be used to turn the light bulb 150 on and off.

Figure 7:
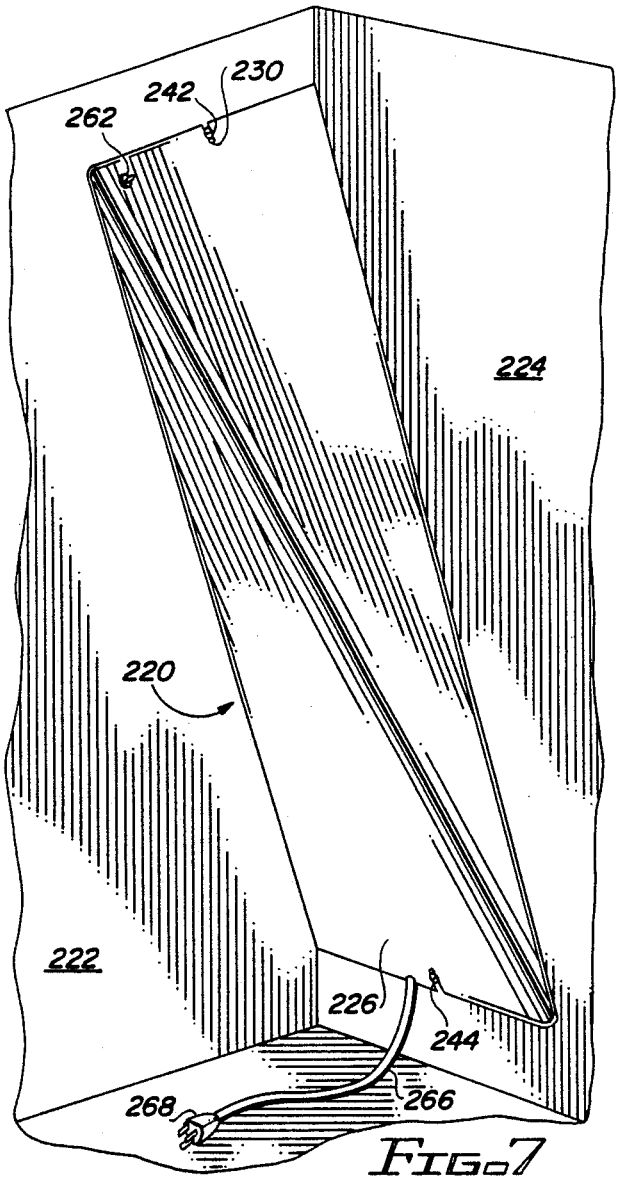
FIG. 7 is a perspective view of a corner light fixture having a radiused bend in the light cover, and a switch mounted in the light cover.
Figure 8:
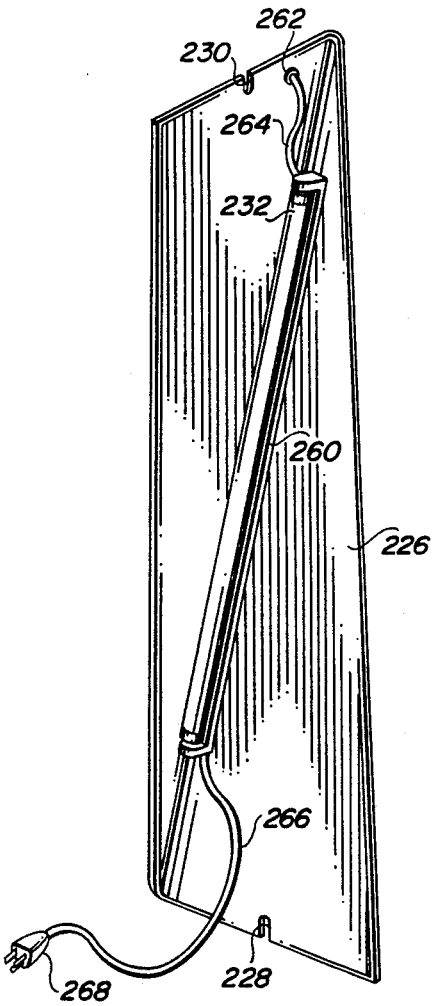
FIG. 8 is a perspective view of an alternate embodiment of the corner light fixture of the present invention, with the fluorescent tube mounted on the inside of the light cover.
Figure 9:
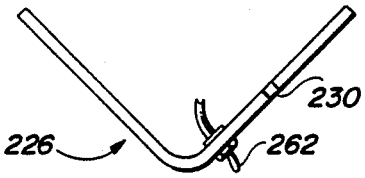
FIG. 9 is an end view of the light cover of the corner light fixture shown in FIG. 7.
Figure 11:
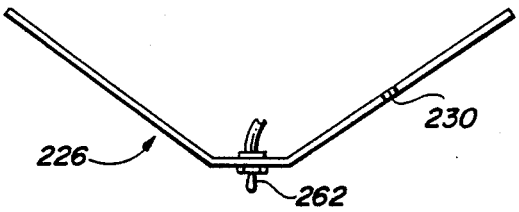
FIG. 11 is a view like FIG. 9 showing an alternative shape for the light cover.

Referring next to FIGS. 7 through 9, a corner light fixture 220 is shown which has a light cover 226 made from a rectangular segment having a smoother bend therein. The corner light fixture 220 is installed onto first and second walls 222 and 224. The light cover 226 is bent around a radius (as shown in FIG. 9) along a diagonal, and has a short slot 228 in the bottom edge thereof and a longer slot 230 in the top edge thereof. The light cover 226 is fastened to the first and second walls 222 and 224 with two screws 242 and 244. An alternative shape is shown in the end view of FIG. 11 in which a pair of break lines at 45 degrees each is employed.

The corner light fixture 220 differs from the previous light fixtures in two other respects in addition to its smoother curve in the bend along the diagonal in the light cover 226. Referring now to FIG. 8, a fluorescent tube 232 is mounted in a socket assembly 260, which socket assembly 260 is attached to the interior of the light cover 226. In the preferred embodiment, the socket assembly 260 is attached to the interior of the light cover 226 using an adhesive, such as a silicone adhesive. Accordingly, when the light cover 226 is mounted on the first and second walls 222 and 224, the entire corner light fixture 220 will be mounted.

The second additional difference illustrated by the corner light fixture 220 is that it has a switch 262 mounted in the light cover 226. The switch 262 is connected to the socket assembly 260 with a segment of wire 264. Completing the assembly of the corner light fixture 220 is a cord 266, which is connected at one end to the socket assembly 260 and at the other end to a plug 168. It will be appreciated that the various features of the corner light fixture 220 need not all be used, but rather selected features could be mixed with selected features shown by other examples of corner light fixtures herein.

Figure 10:
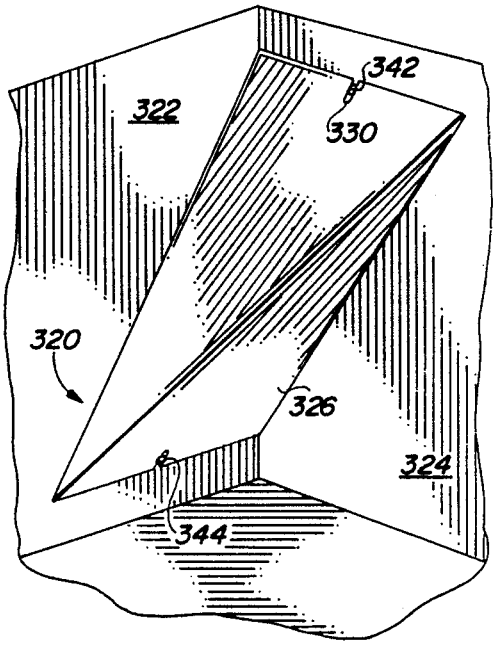
FIG. 10 is a perspective view of a corner light fixture having a light cover with the bend in the other diagonal of the segment of rectangular material.

Referring next to FIG. 10, a corner light fixture 320 is shown which has a light cover 326 made from a rectangular segment again having a sharp bend therein. The corner light fixture 320 is installed onto first and second walls 322 and 324. The light cover 326 is bent along a diagonal different from that of the light fixtures described above to illustrate that either diagonal could be used to make a light cover. The light cover 326 has a short slot 328 (not shown) in the bottom edge thereof and a longer slot 330 in the top edge thereof. The light cover 326 is fastened to the first and second walls 322 and 324 with two screws 342 and 344.

It may thus be seen that the corner lighting fixture of the present invention may be conveniently installed in a room corner, either the corner between two walls, or the corner between the ceiling and a wall. The corner lighting fixture of the present invention is designed to closely fit the contours of a corner, thus providing a built-in look which is quite pleasing to the eye. The fixture is easy to install, and requires only a brief effort and simple hand tools for the entire installation process, thus making the corner fixture of the present invention ideal for installation by do-it-yourselfers.

The corner lighting fixture of the present invention evenly distributes light from a corner in a pleasing manner, and does not throw the light in a direction toward one wall or the other. The corner lighting fixture also presents an aesthetically pleasing appearance, and is an attractive addition to a room or office. In addition, the lighting fixture of the present invention takes up very little space, and does not project from the corner to any significant degree. In fact, the lighting fixture of the present invention fits into spaces where lighting fixtures have not been mounted, until now.

The corner lighting fixture of the present invention is of inexpensive construction, and is thereby an economically attractive product and is appealing to people seeking to add additional lighting to a home or office. It is also durable and long lasting, which features, when combined with its other qualities of being easy to install, effective at providing light for a significant area, and relatively inexpensive, make the corner light fixture of the present invention a highly desirable alternative to traditional wall and ceiling lights.

Although there have been shown and described hereinabove specific arrangements of a lighting cover and combination for corner installation in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. A lighting fixture for installation in a corner between a first wall and a second wall, comprising:

a light cover for placement in the corner between the first wall and the second wall, said light cover being made of a rectangular segment of material which is bent along a diagonal thereof at approximately a ninety degree angle, said light cover being made of material which will allow light to pass therethrough;

a socket assembly for holding a lamp in position under said light cover in the corner between the first wall and the second wall; and means for mounting said light cover in position in the corner between the first wall and the second wall.

2. A lighting fixture as defined in claim 1, wherein said light cover is made of a material which is translucent.

3. A lighting fixture as defined in claim 2, wherein said light cover is made of milky white plastic material.

4. A lighting fixture as defined in claim 2, wherein said cover is made of colored translucent material.

5. A lighting fixture as defined in claim 1, wherein said light cover has a length which is at least approximately 1.25 times its width.

6. A lighting fixture as defined in claim 5, wherein said light cover has a length which is between 1.5 and 10 times as long as its width.

7. A lighting fixture as defined in claim 1, wherein said lighting cover is bent in a relatively sharp bend along said diagonal of said rectangular segment of material.

8. A lighting fixture as defined in claim 1, wherein said lighting cover is bent in a radiused bend along said diagonal of said rectangular segment of material.

9. A lighting fixture as defined in claim 1, wherein said lighting cover is installed in the corner between the first wall and the second wall with one of its shorter sides oriented at the top of said lighting fixture, and the other of its shorter sides oriented at the bottom of said lighting fixture.

10. A lighting fixture as defined in claim 9, wherein said mounting means comprises:

first mounting means located on said light cover; and second mounting means located on the first wall and on the second wall.

11. A lighting fixture as defined in claim 10, wherein said first mounting means comprises:

a first slot located in said one of said shorter sides of said lighting cover; and a second slot located in said other of said shorter sides of said lighting cover.

12. A lighting fixture as defined in claim 11, wherein said second mounting means comprises:

a first screw screwed into the first wall, said first screw being received in said first slot to secure the top of said light cover; and a second screw screwed into the second wall, said second screw being received is said second to secure the bottom of said light cover.

13. A lighting fixture as defined in claim 11, wherein said first slot is a longer slot and said second slot is a shorter slot, said first slot thereby facilitating the installation and removal of said lighting cover.

14. A lighting fixture as defined in claim 1, wherein said socket assembly comprises: a socket for receiving a fluorescent lamp, said socket being mounted in the corner between the first wall and the second wall.

15. A lighting fixture as defined in claim 1, wherein said socket assembly comprises:

a socket for receiving an incandescent lamp, said socket being mounted in the corner between the first wall and the second wall.

16. A lighting fixture as defined in claim 1, additionally comprising:

a switch for turning said lamp on and off.

17. A lighting fixture as defined in claim 16, wherein said switch is mounted in said light cover.

18. A lighting fixture as defined in claim 1, wherein said socket assembly is mounted on the inside of said light cover.

19. A lighting fixture for installation in a corner between a first wall and a second wall, comprising:

a light cover for placement in the corner between the first wall and the second wall, said light cover being made of a rectangular segment of material which is lent along a diagonal thereof at approximately a ninety degree angle, said light cover being made of translucent material which will allow light to pass therethrough, wherein said lighting cover is installed in the corner between the first wall and the second wall with one of its shorter sides oriented at the top of said lighting fixture, and the other of its shorter sides oriented at the bottom of said lighting fixture;

a socket assembly for holding a lamp in position under said light cover in the corner between the first wall and the second wall;

a first longer slot located in said one of said shorter sides of said lighting cover;

a second shorter slot located in said other of said shorter sides of said lighting cover;

a first screw screwed into the first wall, said first screw being received in said first slot to secure the top of said light cover; and a second screw screwed into the second wall, said second screw being received in said second to secure the bottom of said light cover.

20. A lighting fixture for installation in a corner between a first wall and a second wall, comprising:

a light cover made of a rectangular segment of material which is bent along a diagonal thereof;

a socket assembly for holding a lamp in position under said light cover in the corner between the first wall and the second wall; and means for mounting said light cover in position in the corner between the first wall and the second wall.

21. A light cover for installation in a corner between a first wall and a second wall over a source of light, comprising:

a light cover for placement in the corner between the first wall and the second wall, said light cover being made of a rectangular segment of material which is bent along a diagonal thereof at approximately a ninety degree angle, said light cover being made of material which will allow light to pass therethrough; and means for mounting said light cover in position in the corner between the first wall and the second wall.

22. A method of installing a lighting fixture in a corner between a first wall and a second wall, comprising:

mounting a socket assembly for holding a bulb in the corner between the first wall and the second wall;

providing a light cover for installation in the corner between the first wall and the second wall over said socket assembly, said light cover being made of a rectangular segment of material which is bent along a diagonal thereof at approximately a ninety degree angle, said light cover being made of material which will allow light to pass therethrough; and mounting said light cover in position in the corner between the first wall and the second wall.

* * * * *